US007125266B1

(12) United States Patent
Huang

(10) Patent No.: US 7,125,266 B1
(45) Date of Patent: Oct. 24, 2006

(54) ROTATABLE PLUG

(75) Inventor: Tzuhauan Huang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,115

(22) Filed: Dec. 19, 2005

(51) Int. Cl.
*H01R 13/60* (2006.01)
*H01R 13/44* (2006.01)

(52) U.S. Cl. ..... 439/131

(58) Field of Classification Search ..... 439/131, 439/172, 31, 640
See application file for complete search history.

(56) References Cited

U.S. PATENT DOCUMENTS 4,997,381 A * 3/1991 Oh ..... 439/172

* cited by examiner

*Primary Examiner*—Javaid H. Nasri
(74) *Attorney, Agent, or Firm*—Rosenberg, Klein & Lee

(57) ABSTRACT

A rotatable plug includes an upper cover, a lower cover mating with the upper cover, a mount placed in the lower cover, two conductive terminals fixed on the lower cover, a rotatable rack, two connecting members, two first conductive elements and two second conductive elements. The rotatable rack includes a pivot, two seats formed on opposite ends of the pivot and two prongs. Each seat defines a cavity and a leading opening communicating with the cavity. One end of each prong is received and secured on the cavity. The members contact with the corresponding conductive terminals. The first conductive elements are fixed on the other ends of the respective connecting members, and each first conductive element has a first conductive protrusion. One end of each second conductive element is fixed on the prong, and the other end is held in the leading opening and rotatably contacted with the conductive protrusion.

5 Claims, 6 Drawing Sheets

ROTATABLE PLUG

BACKGROUND OF THE INVENTION

1. Field of the Invention

The present invention generally relates to a rotatable plug, and more particularly, to a rotatable plug with an arcing resistant mechanism.

2. The Related Art

With popularization of consumer electronics, various kinds of plugs, especially rotatable plugs come out. Due to their small size for carrying conveniently and beautiful appearance, the rotatable plugs are favored even more. With reference to FIG. 7, a rotatable plug is disclosed below according to a prior art.

The conventional rotatable plug 200 illustrated in FIG. 7 includes an upper cover 210, a lower cover 220 mating with the upper cover 210 to form a holding space, a mount 230 which is placed on the lower cover 220 and held in the holding space, a rotatable rack 240 and two conductive terminals 250 fixed on the lower cover 220 in juxtaposed relationship. Two slots 211 are formed longitudinally in parallel on the top surface of the upper cover 210. The rotatable rack 240 has a pivot 241, and the pivot is placed on the mount 230 rotatably. A seat 242 is formed at each end of the pivot 241. Two prongs 243 are provided, which are fixed on the seats 242 respectively and can be rotated around the pivot 241.

When the rotatable plug 200 is in use, the free end of each prong 243 passes through the corresponding slot 211 and is set on the vertical position exposed out of the upper cover 210 by rotating the rotatable rack 240 for electrically contacting with a receptacle. At this state, the other end of each prong 243 is electrically contacted with the corresponding conductive terminal 250. When the rotatable plug 200 is not in use, the free end of each prong 243 is held in the corresponding slot 211 completely by rotating the rotatable rack 240 reversely, and the other end of each prong 243 separates from the corresponding conductive terminal 250.

As described above, in the course of the conventional rotatable plug 200 being inserted into the corresponding receptacle, the prongs 243 often bias the position which the prongs 243 is exposed out of the upper cover 210 vertically, thus a gap is existed between the prong 243 and the corresponding conductive terminal 250, which may result in an arcing phenomenon. As is well known, the arcing terrifies users, and even more threatens the safety of the user. Furthermore, the arcing releases a lot of heat so as to make the conductive terminal 250 in high temperature. As a result, the conductive terminal 250 will be oxidized easily, and the lifetime of the rotatable plug 200 is reduced. Thus, there is a demand for providing a rotatable plug that can overcome the above shortcomings.

SUMMARY OF THE INVENTION

An object of the present invention is to provide a rotatable plug which can suppress arcing, and the rotatable plug can be used safely and has a long lifetime.

To achieve the above object, the present invention provides a rotatable plug including an upper cover, a lower cover mating with the upper cover to form a holding space, a mount placed on the lower cover and held in the holding space, two conductive terminals disposed on the lower cover, a rotatable rack, two connecting slices, two first conductive elements and two second conductive elements.

The upper cover defines two slots in parallel on the top surface thereof. The rotatable rack includes a pivot, two seats formed on opposite ends of the pivot and two prongs. The pivot is pivotally mounted on the mount. Each seat defines a cavity and a leading opening communicating with the cavity. One end of each prong is received and secured on the cavity, and the other end of said prong passes through the corresponding slot and is rotatable around the pivot to be held in the slot. One ends of the slice contact with the corresponding conductive terminals. The conductive elements are fixed on the other ends of the respective connecting slices, and each first conductive element has a first conductive protrusion. Each first conductive element has a first conductive protrusion. One end of each second conductive element is fixed on the corresponding prong, and the other end is held in the leading opening of the corresponding seat and rotatably contacted with the conductive protrusion of the corresponding first conductive element.

As can be seen from the above description, the first conductive element contacts with the second conductive element all the time in the course of the prongs being rotated around the pivot, and then a circuit is formed between the prong and the conductive terminal by the connecting slice, the first conductive element and the second conductive element, therefore the prong electrically connects with the conductive terminal all the time. As a result, the arcing is suppressed in the rotatable plug, and the rotatable plug has advantages of safety and long lifetime for use.

To achieve the above object, the present invention provides another rotatable plug including an upper cover, a lower cover mating with the upper cover to form a holding space, a mount placed on the lower cover and held in the holding space, two conductive terminals disposed on the lower cover, a rotatable rack, two connecting slices and two first conductive elements. The upper cover defines two slots in parallel on the top surface thereof. The rotatable rack includes a pivot, two seats formed on opposite ends of the pivot and two prongs. The pivot is pivotally mounted on the mount. Each seat defines a cavity and a leading opening communicating with the cavity. One end of each prong is received and secured on the cavity, and the other end of said prong passes through the corresponding slot and is rotated around the pivot to be held in the slot. One ends of the slices contact with the corresponding conductive terminals. The first conductive elements are fixed on the other ends of the corresponding connecting slices, and each first conductive element has a first conductive protrusion which is inserted into the leading opening of the corresponding seat and rotatably contacted with the corresponding prong.

As can be seen from the above description, the first conductive element contacts with the corresponding prong all the time in the course of the prongs being rotated around the pivot, and then a circuit is formed between the prong and the conductive terminal by the connecting slice and the first conductive element, therefore the prong electrically connects with the conductive terminal all the time. As a result, the arcing is suppressed in the rotatable plug, and the rotatable plug has advantages of safety and long lifetime for use.

BRIEF DESCRIPTION OF THE DRAWINGS

The present invention will be apparent to those skilled in the art by reading the following description of embodiment thereof, with reference to the attached drawings, in which.

DETAILED DESCRIPTION OF THE PREFERRED EMBODIMENT

Figure 1:
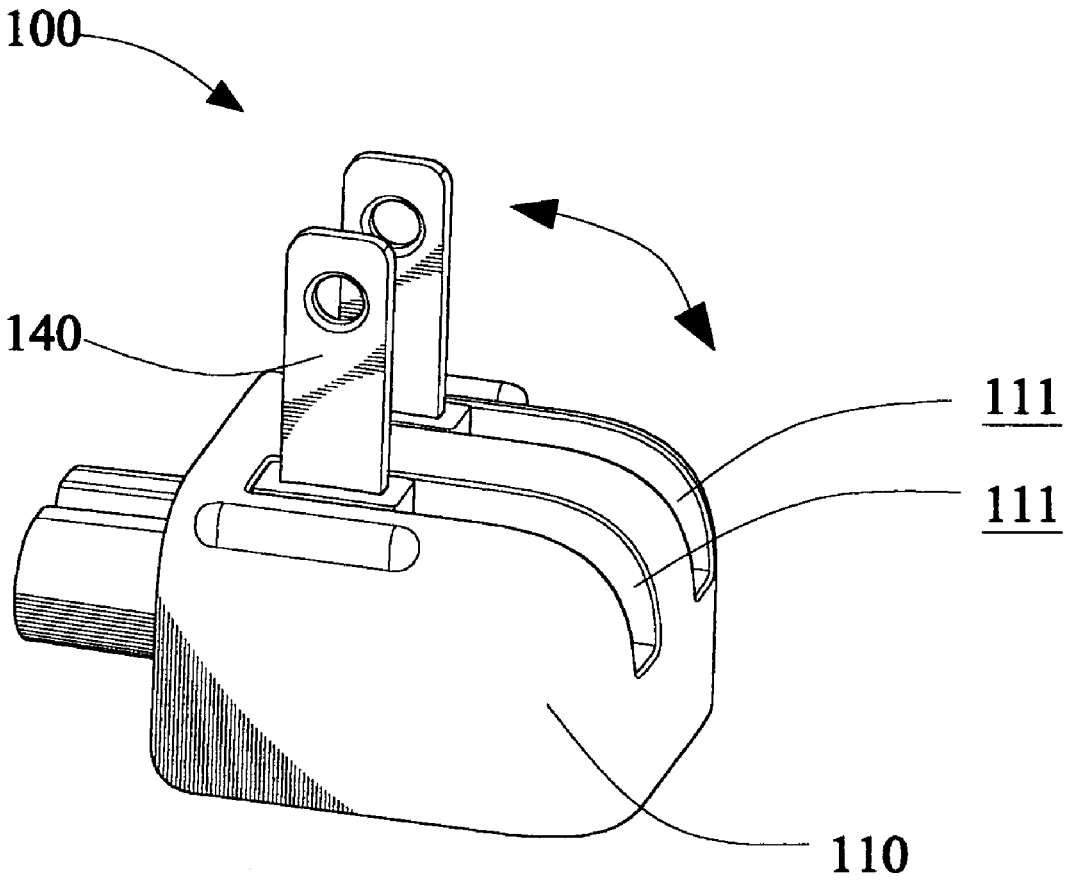
FIG. 1 is a perspective view of a rotatable plug according to the present invention.
Figure 2:
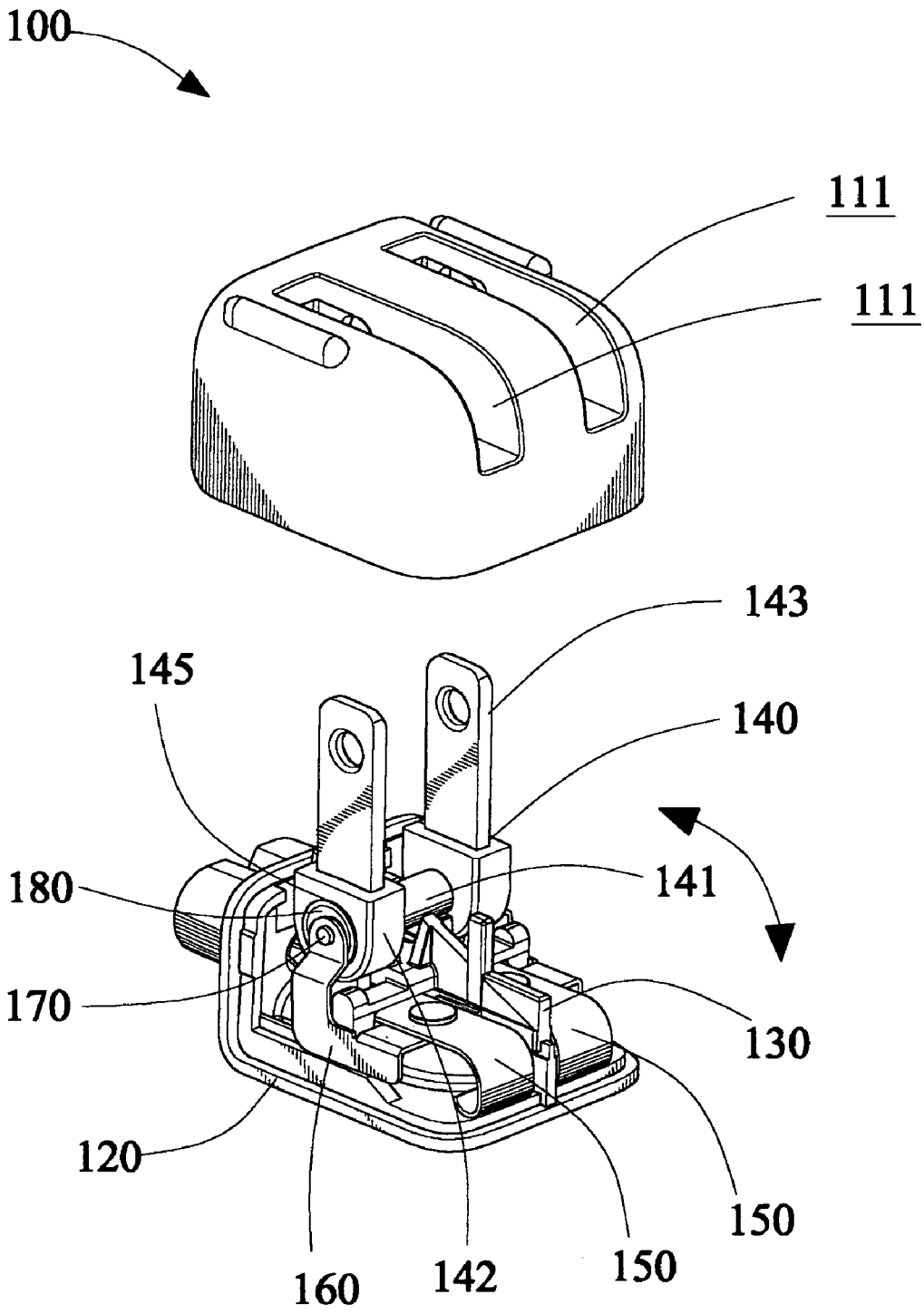
FIG. 2 is a perspective view of the rotatable plug with an upper cover of the rotatable plug exploded therefrom.

With reference to FIG. 1 and FIG. 2, a rotatable plug 100 is disclosed which includes an upper cover 110, a lower cover 120 mating with the upper cover 110 to form a holding space, a mount 130 placed on the lower cover 120 and held in the holding space, a rotatable rack 140 supported by the mount 130, two conductive terminals 150 disposed on the lower cover 120, and two connecting slices 160, two first conductive elements 170 and two second conductive elements 180. There are two slots 111 defined on the top surface of the upper cover 110. The slots 111 are set in parallel along the transversal direction for the rotatable rack 140 passing therethrough and being held therein.

Figure 3:
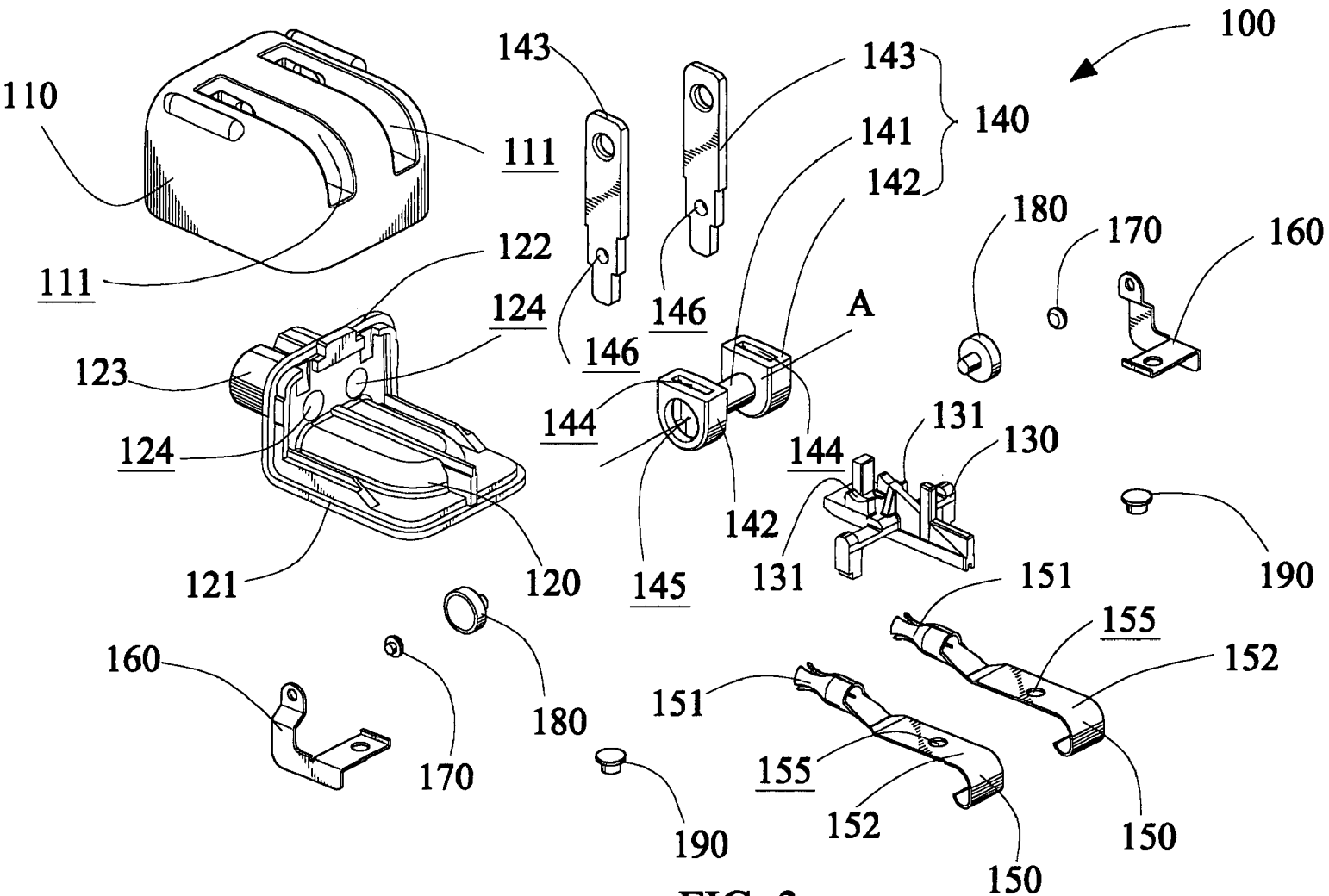
FIG. 3 is an exploded perspective view of the rotatable plug shown in FIG. 1.

Along with reference to FIG. 3, the lower cover 120 has a base 121 and a vertical wall 122 extending upwardly from the front side of the base 121. A protrusion 123 is extended from the outer surface of the vertical wall 122. Two openings 124 are formed in the protrusion 123, which are used to fix the conductive terminals 150.

Each conductive terminal 150 has an engagement portion 151 and a contact portion 152. The engagement portion 151 is shaped into a tube for engaging with a probe of a corresponding receptacle (not shown in drawings) and fastened in the corresponding opening 124. The contact portion 152 electrically contacts with the corresponding connecting slice 160. Furthermore, each contact portion 152 is provided with a first locking aperture 155.

The mount 130 is placed on the base 121 of the lower cover 120, which has two juxtaposing posts 131. Each post 131 has a concave on the top surface thereof for supporting the rotatable rack 140.

The rotatable rack 140 includes a pivot 141, two seats 142 formed on opposite ends of the pivot 141 and two prongs 143 fixed on the seats 142 respectively. The pivot 141 is placed on the posts 131 of the mount 130 and can be rotated around the axis A of the pivot 141. Each seat 142 defines a cavity 144 extending perpendicularly to the axis A and opening upwards, and a leading opening 145 extending parallel with the axis A and opening sideward and communicating with the cavity 44. One end of each prong 143 is received and fixed in the cavity 144, while the other end passes through the corresponding slot 111 of the upper cover 110. The prong 143 is rotatable around the axis A between a vertical position at which the prong 143 is exposed out of the upper cover 210 vertically and a hidden position at which the prong 143 is held in the corresponding slot 211 completely. Each prong 143 defines a first fixing hole 146 at the end received in the cavity 144. When the end of the prong 143 passes through the slot 111 and is exposed out of the upper cover 210 vertically, the prong 143 can be inserted into a corresponding receptacle (not shown in drawings).

Figure 4:
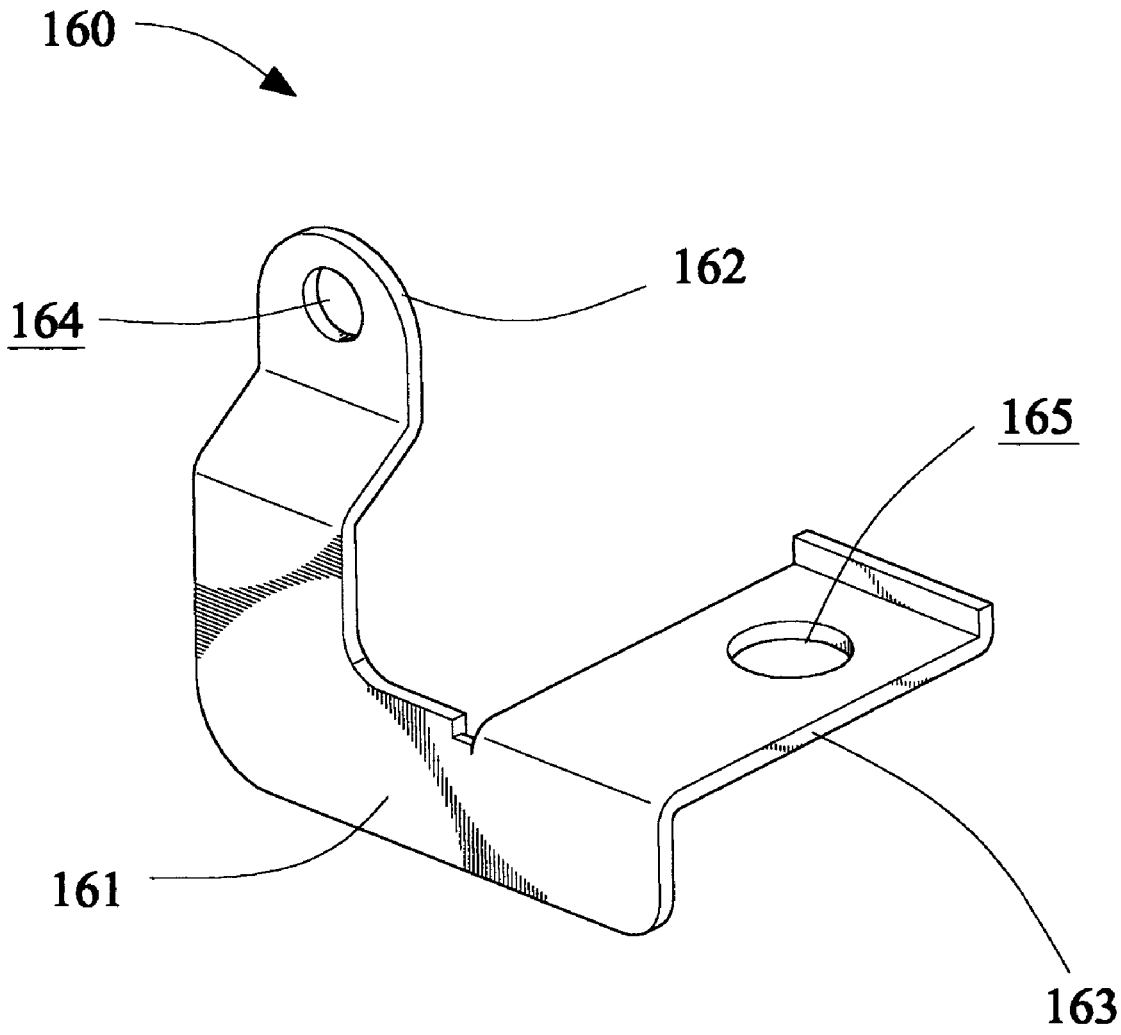
FIG. 4 is a perspective view of a connecting slice for the rotatable plug.

With reference to FIG. 4, the connecting slice 160 has a transferring portion 161, a fixing portion 162 and a conductive portion 163. The fixing portion 162 and the conductive portion 163 are bent and extended from both ends of the transferring portion 161 respectively. The fixing portion 162 defines a second fixing hole 164. The conductive portion 163 electrically contacts with the contact portion 152 of the conductive terminal 150. In order to make the conductive portion 163 contact with the contact portion 152 tightly, a second locking aperture 165 is formed in the conductive portion 163, and the rotatable plug further provides a locking bolt 190. The locking bolt 190 passes through the first locking aperture 155 and the second locking aperture 165 to fix the contact portion 152 to the conductive portion 163. Therefore the conductive portion 163 contacts with the contact portion 152 tightly.

Figure 5:
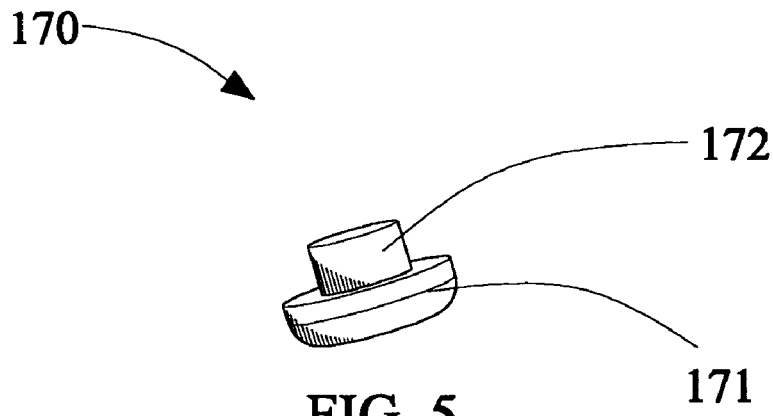
FIG. 5 is a perspective view of a first conductive element for the rotatable plug.

With reference to FIG. 5, each first conductive element 170 has a conducting protrusion 171, and a first fixing portion 172 extending from the conducting protrusion 171. The first fixing portion 172 is shaped into a column and fixed on the connecting slice 160 after passing through the second fixing hole 164.

Figure 6:
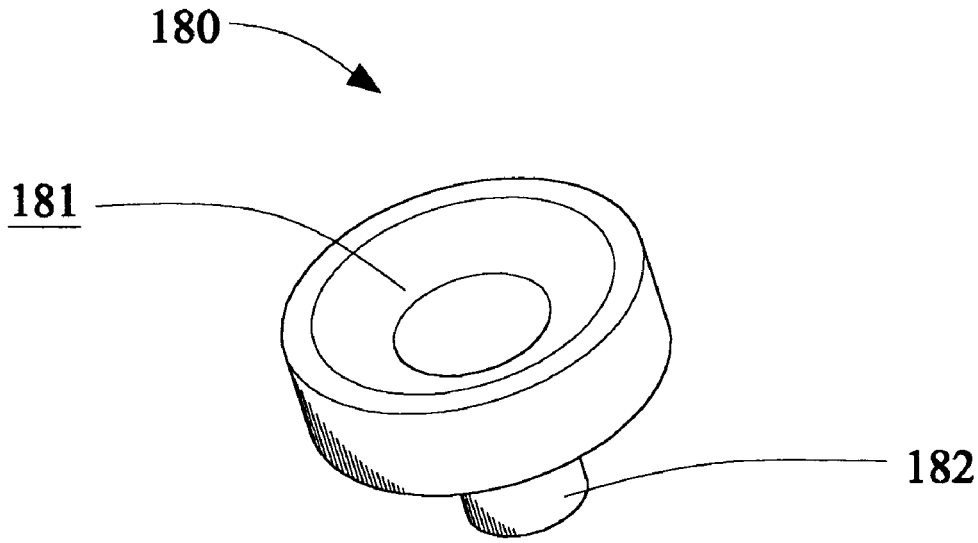
FIG. 6 is a perspective view of a second conductive element for the rotatable plug.
Figure 7:
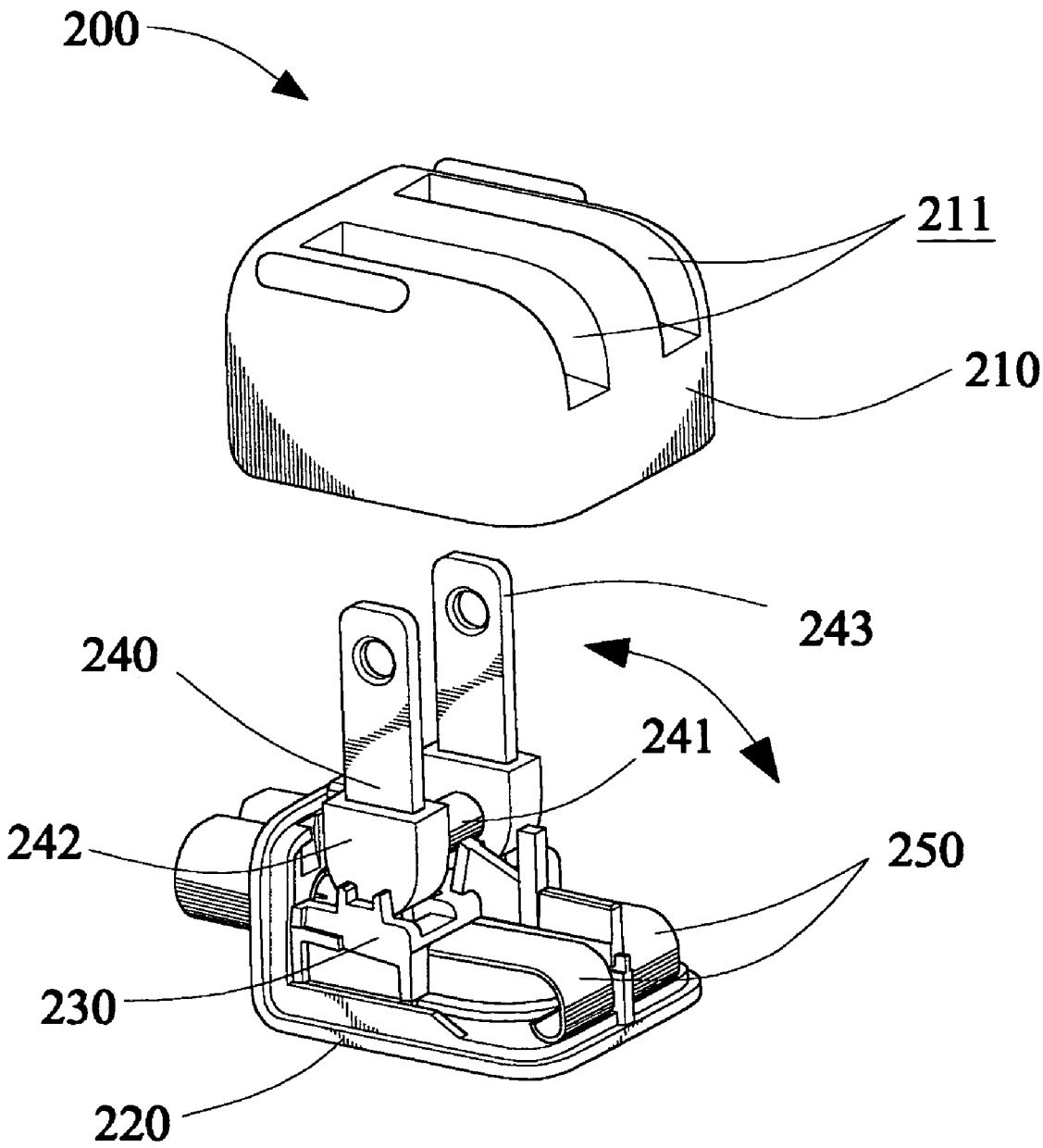
FIG. 7 ( PRIOR ART )
FIG. 7 is a perspective view of a rotatable plug according to a prior art.

With reference to FIG. 2 and FIG. 6, each second conductive element 180 is held in the leading opening 145 of the corresponding seat 142 with one end defining an indentation 181 which rotatably contact with the conducting protrusion 171 of the first conductive element 170 and the other end forming a second fixing portion 182 which engages with the first fixing hole 146 of the corresponding prong 143.

In order to lower the friction between the first conductive element 170 and the second conductive element 180 to make the prong 143 rotate smoothly, the conducting protrusion 171 of the first conductive element 170 is made of copper-silver alloy.

According to the mentioned above, the first conductive element 170 contacts with the second conductive element 180 all the time in the course of the prongs 143 being rotated around the axis A, and then a circuit is formed between the prong 143 and the conductive terminal 150 by the connecting slice 160, the first conductive element 170 and the second conductive element 180, therefore the prong 143 electrically connects with the conductive terminal 150 all the time. As a result, the arcing is suppressed in the rotatable plug 100, and the rotatable plug 100 in the present invention has advantages of safety and long lifetime for use.

Although the invention has been described above by reference to a certain embodiment of the invention, the invention is not limited to the embodiment described above. Modifications and variations of the embodiments described above will occur to those skilled in the art, in light of the above teachings.

What is claimed is:

1. A rotatable plug comprising:

an upper cover defining two slots in parallel on the top surface thereof;

a lower cover mating with the upper cover to form a holding space;

a mount placed on the lower cover and held in the holding space;

two conductive terminals disposed on the lower cover;

a rotatable rack including a pivot, two seats formed on opposite ends of the pivot and two prongs, the pivot being pivotally mounted on the mount, each seat defining a cavity for receiving and securing one end of each prong and a leading opening communicating with the cavity, another end of said prong passing through the corresponding slot and being rotatable around the pivot to be held in the slot;

two connecting members, one end of each of the members contacting with the corresponding conductive terminals;

two first conductive elements fixed on the other ends of the respective connecting members, each first conductive element having a first conductive protrusion; and two second conductive elements, one end of each second conductive element being fixed on the corresponding prong, another end being held in the leading opening of the corresponding seat and rotatably contacting with the conductive protrusion of the corresponding first conductive element.

2. The rotatable plug as claimed in claim 1, wherein the end of the second conductive element held in the leading opening of the corresponding seat has an indentation, and the indentation engages with the conducting protrusion of the first conductive element.

3. The rotatable plug as claimed in claim 1, wherein the conducting protrusion of the first conductive element is made of copper-silver alloy.

4. The rotatable plug as claimed in claim 1, wherein each conductive terminal defines a first locking aperture, the end of each connecting member contacting with the conductive terminal defines a second locking aperture, the rotatable plug further comprises two locking bolts each passing through the first locking aperture and the second locking aperture to fix the connecting member to the conductive terminal.

5. A rotatable plug comprising:

an upper cover defining two slots in parallel on the top surface thereof;

a lower cover mating with the upper cover to form a holding space;

a mount placed on the lower cover and held in the holding space;

two conductive terminals disposed on the lower cover;

a rotatable rack including a pivot, two seats formed on opposite ends of the pivot and two prongs, the pivot pivotally mounted on the mount, each seat defining a cavity for receiving and securing one end of each prong and a leading opening communicating with the cavity, another end of said prong passing through the corresponding slot and being rotatable around the pivot to be held in the slot;

two connecting members one end of each of the members contacting with the corresponding conductive terminals; and two conductive elements fixed on another ends of the corresponding connecting members, each first conductive element having a first conductive protrusion extending into the leading opening of the corresponding seat to rotatably contact with the corresponding prong.

* * * * *

UNITED STATES PATENT AND TRADEMARK OFFICE

CERTIFICATE OF CORRECTION

PATENT NO. : 7,125,266 B1
APPLICATION NO. : 11/305115
DATED : October 24, 2006
INVENTOR(S) : Tzuhauan Huang It is certified that error appears in the above-identified patent and that said Letters Patent is hereby corrected as shown below:

In the Title Page:

Insert --(30) Foreign Application Priority Data

March 14, 2005 (TW) .....94203900 U--.

Signed and Sealed this

Ninth Day of January, 2007

JON W. DUDAS
*Director of the United States Patent and Trademark Office*